US006550463B1

(12) United States Patent
Schmolla

(10) Patent No.: US 6,550,463 B1
(45) Date of Patent: Apr. 22, 2003

(54) METHOD AND SWITCHING SYSTEM FOR THE IGNITION OF AN INTERNAL COMBUSTION ENGINE

(76) Inventor: Wilfried Schmolla, Am Steinberg 81, D-63128 Dietzenbach (DE)

( * ) Notice: Subject to any disclaimer, the term of this patent is extended or adjusted under 35 U.S.C. 154(b) by 0 days.

(21) Appl. No.: 09/786,643

(22) PCT Filed: Jul. 6, 1999

(86) PCT No.: PCT/EP99/04684

§ 371 (c)(1),
(2), (4) Date: Mar. 7, 2001

(87) PCT Pub. No.: WO00/14404

PCT Pub. Date: Mar. 16, 2000

(30) Foreign Application Priority Data

Sep. 7, 1998 (DE) ..... 198 40 765

(51) Int. Cl.[7] ..... F02P 3/00
(52) U.S. Cl. ..... 123/606; 123/605
(58) Field of Search ..... 123/596–620

(56) References Cited

U.S. PATENT DOCUMENTS 4,149,508 A * 4/1979 Kirk, Jr. et al.
4,567,874 A * 2/1986 Rouanes ..... 123/606
4,998,526 A 3/1991 Gokhale
5,113,839 A 5/1992 Hartmann et al.
5,131,376 A * 7/1992 Ward et al. ..... 123/598
5,179,928 A 1/1993 Cour et al. ..... 123/606
5,513,618 A * 5/1996 Rich et al. ..... 123/598
6,138,653 A * 10/2000 Juffinger ..... 123/598

FOREIGN PATENT DOCUMENTS

| | | |
|---|---|---|
| DE | 3840315 C1 | 3/1990 |
| DE | 196 25 422 A1 | 1/1997 |
| DE | 197 23 784 C1 | 6/1997 |
| DE | 198 40 765 A1 | 3/2000 |
| JP | 9-68149 | 11/1997 |

* cited by examiner

*Primary Examiner*—Paul J. Hirsch

(57) ABSTRACT

A method and a system for the ignition of an internal combustion engine in which a high voltage is applied to the electrodes (8.1, 8.2) of a spark plug (8). The high voltage produces a voltage disruptive discharge on the electrodes (8.1, 8.2) of the spark plug (8) and the combustion phase is maintained over the voltage disruptive discharge. The electric power for triggering a disruptive discharge at the electrodes (8.1, 8.2) of a spark plug is supplied according to a self-induction method, while the combustion phase is maintained by the voltage resonant conversion.

14 Claims, 3 Drawing Sheets

METHOD AND SWITCHING SYSTEM FOR THE IGNITION OF AN INTERNAL COMBUSTION ENGINE

DESCRIPTION

Figure 1:
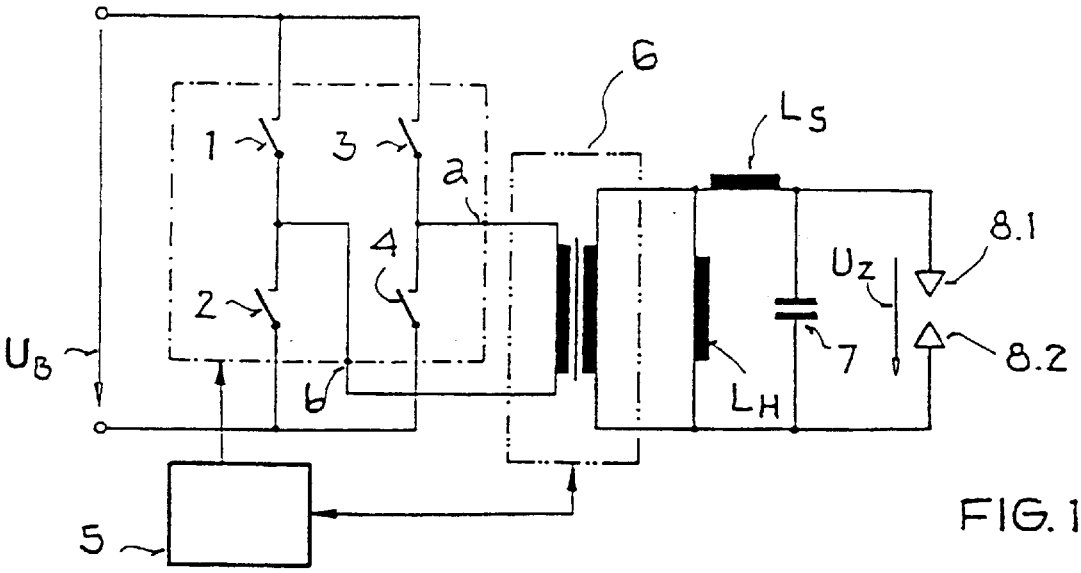

The invention relates to a method and a circuit arrangement for the ignition of an internal-combustion engine, as defined in the preambles to the independent claims.

Known ignition systems, which are commonly used in motor vehicles, comprise an ignition coil, an ignition distributor and spark plugs. A high voltage is generated in the ignition coil, then supplied via the ignition distributor to the individual spark plugs. The generated high voltage is typically in a range between 20 kV and 30 kV. The high voltage leads to a voltage arc-over at the spark-plug electrodes, which ignites the fuel/air mixture. It is also known to provide an electronic ignition distribution instead of a rotating, so-called distributor finger in an ignition distributor. Because of the high energy that must be available for the ignition process, the ignition coil must have a large volume, and, from the output of the ignition coil, the circuit arrangement must be high-voltage-proof for avoiding voltage arc-overs onto the vehicle chassis.

U.S. Pat. No. 5,113,839 discloses an ignition method in which a high-frequency ignition is triggered by the application of an AC voltage to the spark-plug electrodes. A supply unit for 200 V is required for executing the method, and the efficiency is reduced.

DE-A1 196 25 422 discloses a hybrid ignition circuit for an internal-combustion engine, in which the ignition-spark breakdown is generated by a capacitor discharge, and the combustion of the engine spark is maintained by an AC voltage in a flow converter.

EP 0 482 127 B1 discloses a method in which the voltage for the voltage arc-over and the combustion phase is generated via a resonant transformation. The problem here is that the method is energy-consuming, and the spark plug is subjected to a great deal of wear.

It is the object of the invention to provide a method and a circuit arrangement with which an ignition system of the above-described type is improved so as to have a particularly compact, energy-saving design, with the spark plugs being subjected to little wear.

The object is accomplished by the features of the independent claims. Modifications and advantageous embodiments ensue from the dependent claims and the description.

The method in accordance with the invention involves supplying electrical energy for triggering a voltage arc-over at the spark-plug electrodes with a self-induction method, in which a transformer supplies a voltage to the spark plug and an abrupt reduction in the current flow through the primary side of the transformer causes the voltage arc-over, and the combustion phase is maintained by means of a resonant voltage transformation, with a resonant frequency being determined by inductive and capacitive elements on the secondary side of a transformer.

In a preferred embodiment of the invention, the same transformer is used for the self-induction and for maintaining the combustion phase.

It is advantageous to supply the spark plug with a high-frequency AC voltage during the combustion phase. The spark plug is preferably supplied with electrical power of a frequency higher than 100 kHz during the combustion phase. In a further preferred embodiment of the method, the spark plug is supplied with electrical power of a frequency in a range of 1 MHz to a few hundred MHz in the combustion phase.

In a further preferred embodiment, during the combustion phase, the spark plug is supplied with a high-frequency AC voltage, which is superposed with a DC voltage or a low-frequency AC voltage.

The circuit arrangement of the invention for the ignition of an internal-combustion engine is characterized by the fact that supply elements for the spark plug have at least four switches in a bridge circuit for supplying a voltage to the electrodes.

A further circuit arrangement of the invention for the ignition of an internal-combustion engine is characterized by the fact that supply elements for the spark plug have at least two switches in a push-pull circuit with a transformer for supplying a voltage to the electrodes.

In a further preferred embodiment, two switches and two voltage sources are disposed in a partial-bridge circuit.

At least one coil and/or one transformer is or are preferably disposed, as an inductance of a resonant circuit, between the switches and electrodes. The transformer represents an inductance, at least in regions, and is a component of both the resonant circuit and the voltage transformation of the self-induction circuit.

The bridge circuit is preferably connected to an actuation unit that opens and closes the switches according to the requirements of the ignition phase and the combustion phase.

In a preferred embodiment, the resonant transformation circuit comprises at least one Collins filter.

In an especially preferred embodiment, the resonant transformation circuit comprises at least one series resonant circuit.

A common transformer is advantageously provided for generating a self-induction voltage for the voltage arc-over and for generating the resonant voltage transformation.

It is beneficial to provide a separate resonant transformation circuit for each spark plug. The advantage is that transformation circuit and the spark plug can be integrated into a unit.

Elements are advantageously provided for combining the self-induction, the resonant transformation and the spark plug into an ignition-unit component.

The provision of elements for combining the self-induction, resonant transformation, spark plug and actuation electronics into an ignition-unit component is especially beneficial.

In an advantageous embodiment, an ignition unit can be connected to elements for self-induction and resonant transformation, and the spark plug, by means of a plug connection.

In an advantageous modification of the arrangement according to the invention, the resonant transformation circuit is connected at its input to an AC-voltage source and a DC-voltage source.

It is particularly advantageous to integrate the entire arrangement into a cylinder head.

Figure 2:
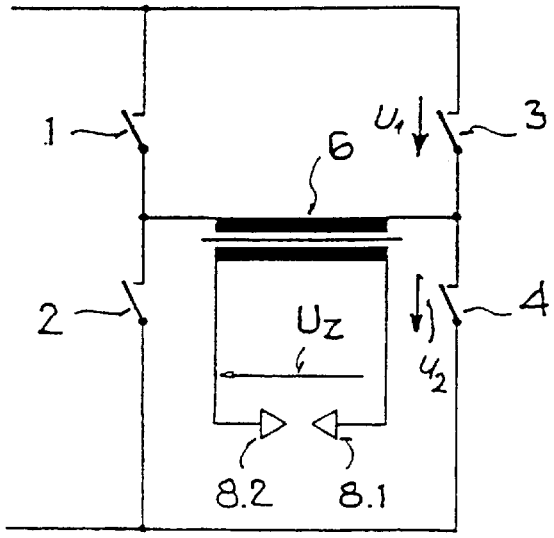
Figure 3:
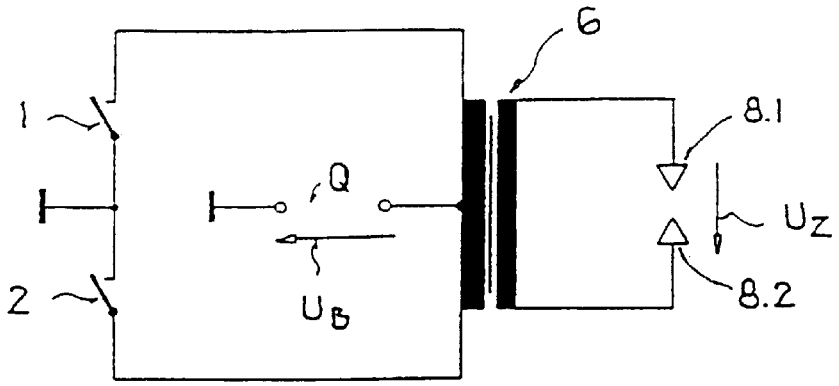
Figure 4:
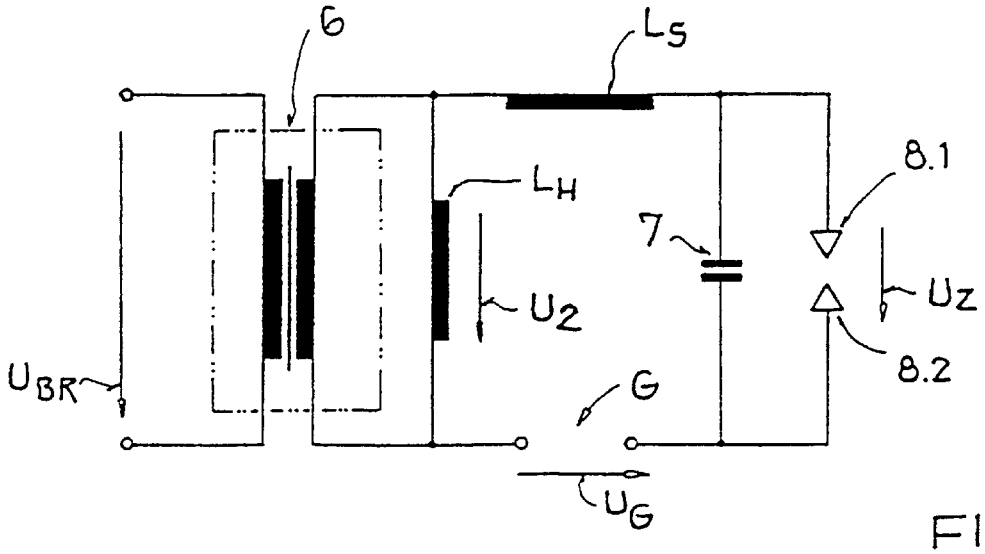
Figure 5:
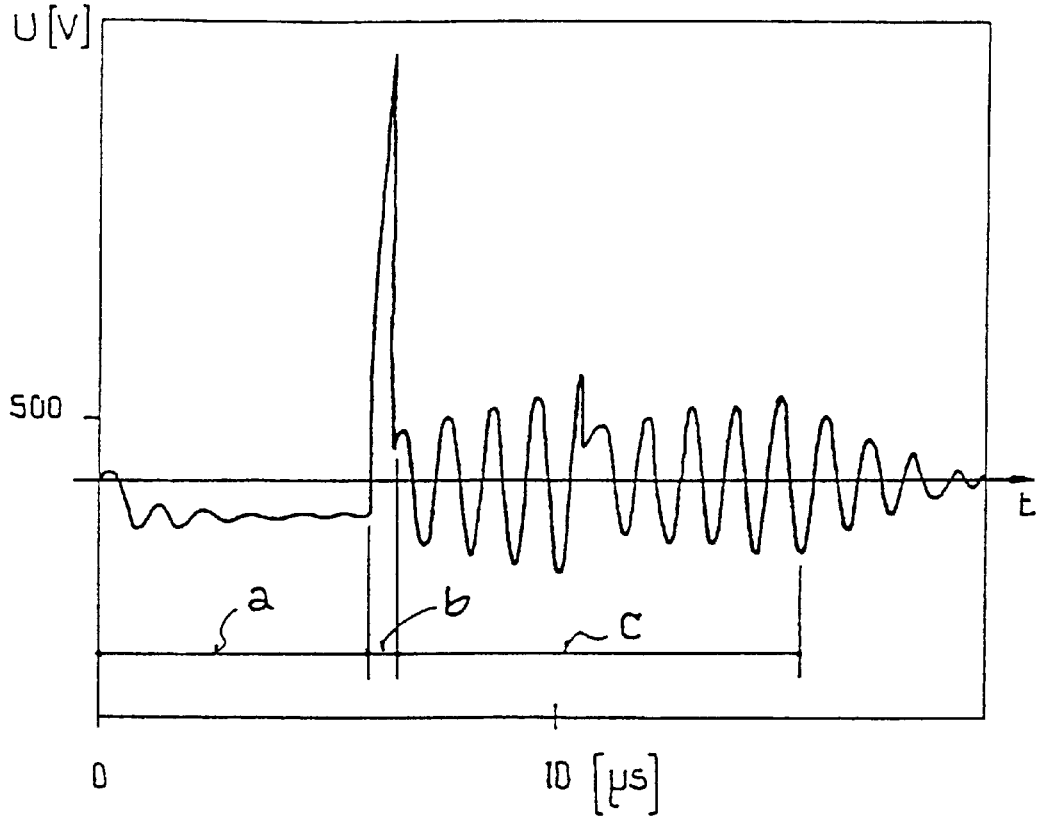
Figure 6:
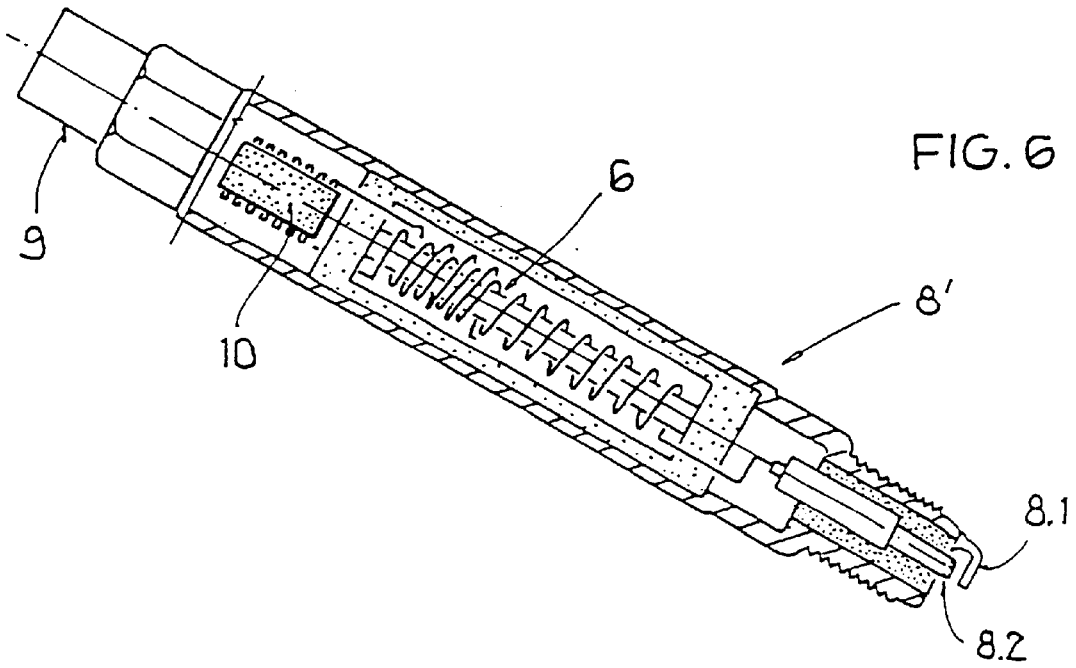

The essential features of the invention are explained in detail below in conjunction with figures. Shown are in:

FIG. 1 a fundamental outline of a circuit for an ignition unit in accordance with the invention;

FIG. 2 a fundamental outline of a further circuit for an ignition unit in accordance with the invention;

FIG. 3 a fundamental outline of a further circuit for an ignition unit in accordance with the invention;

FIG. 4 a further fundamental outline of a circuit for an ignition unit in accordance with the invention, with an additional DC-voltage source;

FIG. 5 the curve of the ignition voltage of the ignition unit with a self-induction phase, a breakdown phase and a combustion phase; and FIG. 6 details of an ignition unit in accordance with the invention.

In the claimed method, the voltage arc-over is generated through self-induction in the formation of the ignition spark: On the primary side, the current flow is abruptly reduced at a transformer provided for supplying a voltage to a secondary-side spark plug—in particular, the opening of a switch cuts off the current. The abrupt current drop induces a voltage increase in the primary coil, in accordance with Lenz's law, the increase being proportional to the change in current over time. The voltage increase is also correspondingly transmitted into the secondary coil of the transformer. The transformer coils replace the conventional ignition coil. The spark plug fires when the secondary-side voltage suffices to ignite a plasma between the electrodes of the spark plug.

The combustion phase of the ignition spark, in contrast, is maintained by a resonant voltage transformation. In comparison to a method in which the combustion phase is only supported by self-induction, the energy content of the coils is significantly lower, because only a relatively small quantity of energy must be drawn from the coil for the voltage arc-over, but not the larger quantity of energy for maintaining the combustion phase.

Thus, the structural size of the transformer coils can be reduced in comparison to a conventional ignition coil, in which the ignition and combustion phases must be supported by the energy content of the coil. A further advantage over a method that supports both the ignition and combustion phases with a resonant voltage transformation lies in the significantly lower energy consumption and the smaller structural size of the transformer coils that must supply a comparatively low energy content in the combustion phase. In particular, the buildup of the ignition voltage prior to the ignition, which is energy-consuming due to the resonant transformation, is essentially avoided.

Furthermore, high-frequency voltages are avoided, so electronic components in the arrangement are stressed less overall. The inventive combination of self-induction for generating the ignition spark with a resonant voltage transformation for maintaining the combustion phase has proven especially advantageous, because this additionally permits a very compact structure of the arrangement and the integration of the arrangement into an ignition unit of small dimensions.

FIG. 1 is a fundamental outline of a circuit for an ignition unit according to the invention. The electrodes 8.1 and 8.2 symbolize a spark plug 8, which has a parasitic capacitance 7. The secondary side of a transformer 6 is connected between the electrodes 8.1, 8.2. It is particularly advantageous to provide a common transformer 6 for generating the self-induction voltage and the resonant voltage transformation. For the sake of simplicity, only the secondary side of the transformer is included in the discussion of the resonant transformation; it is represented by its leakage inductance Ls and its main capacitance $L_H$. An influence of the transmission ratio ü is disregarded; the transmitter of the transformer is considered to be a low-loss transmitter.

On the secondary side, the transformer 6 has a leakage inductance $L_s$ in series with the parasitic capacitance 7 of the spark plug 8. The main inductance $L_H$ of the transformer 6 is parallel to the series connection of the capacitance 7 and the leakage inductance Ls.

In accordance with the invention, the leakage inductance Ls and the parasitic spark-plug capacitance 7 essentially form a series resonant circuit of the resonant voltage transformation, while a different part of the transformer 6 with the main inductance $L_H$ is parallel to the series resonant circuit comprising $L_s$ and the capacitance 7, and is used in the voltage transformation in the self-induction.

If an input voltage $U_BR$, particularly having an amplitude that corresponds to the on-board voltage UB, is briefly present on the primary side of the transformer 6, and if the transmission ratio of the transformer 6 is determined by ü, the voltage drop ΔU across the secondary side of the transformer is $ü \cdot U_{BR}$.

On the primary side of the transformer 6, the output of a bridge circuit having four switches 1, 2, 3, 4, particularly semiconductor switches, is disposed at the connections A and B. The switches 1, 2, 3, 4 are actuated with a conventional actuation circuit 5, not shown in detail. The supply voltage $U_B$ is applied to the input side of the bridge circuit. For building up the magnetic field in the coil of the transformer 6, a respective pair of the switches 1 and 4 or 2 and 3 is closed. For triggering the ignition spark, at least one of the switches 1, 2, 3, 4 is opened, and the current flow through the primary coil is abruptly reduced or cut off. The voltage on the primary side is increased in the manner described at the outset until the plasma between the electrodes 8.1, 8.2 of the spark plug 8 is ignited.

FIG. 2 illustrates a preferred arrangement that includes two switches 1, 2 and two voltage sources U1, U2, which are connected in series, with the transformer 6 being connected between the center tap between the switches connected in series and the center tap between the two voltage sources U1 and U2. The alternating opening and closing of the switches 1 and 2 supplies an AC voltage to the transformer 6. The arrangement of the spark plug 8 with its electrodes 8.1, 8.2 and its parasitic capacitance 7 and the control logic 5 corresponds to the arrangement in FIG. 1, and is not shown in detail.

FIG. 3 depicts a further preferred arrangement of a push-pull circuit having two switches 1, 2 and a voltage source U3. The voltage source U3 is connected to a center tap of the transformer 6, which accordingly has two primary-side partial coils with windings that are wound in opposite directions. In the alternating opening and closing of the switches 1 and 2, the primary side of the transformer 6 is supplied with an AC voltage $U_BR$.

The signal shape of UBR preferably corresponds to a rectangular pulse sequence having an amplitude between $-U_B$ and $+U_B$, and a frequency that is the resonant frequency of the resonating circuit, which comprises elements on the secondary side of the transformer 6, particularly the leakage inductance of the secondary coil and the capacitance between the electrodes 8.1 and 8.2. The resonating circuit has a resonant frequency.

The switches 1 and 2 are opened and closed with this frequency. A switch is advantageously actuated precisely when the amount of the voltage amplitude $U_z$ between the electrodes 8.1 and 8.2 is maximal. In this case, the maximum value of the amount increases with an increasing number of voltage pulses. These considerations also apply in the other exemplary embodiments.

In a further advantageous embodiment, which is not shown separately, the resonating circuit has two resonant frequencies. The arrangement corresponds to the one shown in FIG. 3, but only includes a single switch, and the primary coil has only one partial coil.

When the switch is closed on the primary side of the transformer 6, a voltage $U_2$ is impressed upon the secondary side. The resonant frequency corresponds to the resonant frequency of the resonating circuit comprising the leakage inductance $L_s$ and the capacitance 7 between the electrodes 8.1, 8.2. If the switch is opened, a self-induction voltage is built up and transformed into the secondary coil in accordance with Lenz's law. In this no-load scenario, the inductance of the resonating circuit is formed by the sum of the main inductance $L_H$ and the leakage inductance Ls of the secondary coil of the transformer 6, so when the switch is open, the resonating circuit has a second, lower resonant frequency. The switch is preferably actuated in the amount maximum of the voltage $U_z$, as in the previous example, with the signal shape of $U_z$ being asymmetrical.

FIG. 4 illustrates a further, preferred arrangement of a circuit for an ignition unit according to the invention. The switches of the arrangement can be embodied in partial- or full-bridge arrangements, corresponding to the examples in FIGS. 1 through 3, and are not shown separately. A voltage source supplies a voltage $U_{BR}$ to a transformer 6. The voltage, which drops across the main inductance $L_H$, is $u_2=U_{BR}\cdot\ddot{u}$. In addition, a further voltage source G is implemented in the secondary circuit of the transformer 6. This voltage source G is preferably a DC-voltage source or a voltage source having a low-frequency voltage. It can advantageously serve in performing ion current measurements, which can preferably be used to determine status values of the engine.

FIG. 5 illustrates a voltage time diagram in the self-induction phase, the breakdown phase and the subsequent combustion phase according to the invention. In the time period a, the energy in the magnetic field of the primary-side coil of the transformer is built up for the breakdown or voltage arc-over for generating the ignition spark. The actuation unit 5 emits actuation signals during this time, so the switches 1 and 4 are closed and the switches 2 and 3 are open. While the self-induction voltage is built up in Phase b, an electrical charge flows to the electrodes.

Elements for measuring current, voltage and/or a magnetic field can be provided in the transformer 6; these elements transmit the values back to the actuation unit 5. If the voltage or energy in the magnetic field in the transformer 6 suffices for ignition, the actuation unit 5 emits the signal for opening at least one of switches 1 or 4. Because of Lenz's law, this results in a voltage increase on the secondary side of the transformer. This phase corresponds to the interval b in FIG. 5. The voltage builds up to the breakdown, during which a plasma between the electrodes 8.1 and 8.2 ignites, and voltage values of about 30 kV can easily be attained. Excess energy from the transformer can briefly maintain the initial combustion process between the electrodes 8.1, 8.2. After the plasma has ignited, the voltage breaks down to a lower value, and only attains peak values of up to 500 to 600 V. The precise voltage values are a function of, among other things, the precise design of the spark plug 8 and the properties of the gas surrounding the electrodes 8.1, 8.2. The subsequent combustion process is then maintained by a resonant voltage transformation. This corresponds to Phase c in FIG. 5.

To maintain the combustion period, the switches 1, 2, 3, 4 of the bridge circuit are alternately opened and closed such that the transformer 6 is supplied with an AC voltage or voltage pulses of a frequency that is preferably higher than 100 kHz, especially preferably higher than 1 MHz. In this case, a strong magnetic coupling between the primary and secondary sides of the transformer is advantageous. If the magnetic coupling between the primary and secondary sides of the transformer is weak, it is advantageous to use frequencies lower than 100 kHz.

The gas breakdown can preferably be detected through the analysis of the AC voltage relative to the alternating current in Phase c, and/or the voltage breakdown, and/or through optical observation of the plasma. A corresponding signal of an ignition-verification element can be transmitted to the actuation electronics 5.

In the simplest case, the resonant circuit for the resonant transformation is formed by the leakage inductance $L_s$ of the transformer 6 and the parasitic capacitance 7 of the spark plug 8. A separate resonant transformation circuit having a capacitor and an inductance can also be provided, however, in which instance each spark plug 8 preferably has such a circuit.

If the generator supplies a sufficiently-high input voltage, e.g., a few hundred Volts, a coil can be used instead of a transformer 6.

Because the energy content required for ignition is smaller than the energy content that would be required for ignition and the maintenance of the combustion phase, the transformer can be relatively small, so it can be integrated into an ignition unit. Each spark plug 8 automatically has a separate resonant transformation circuit.

It is also possible to combine the actuation electronics 5 with the spark plug 8 and the transformer 6 to form an ignition unit in a component. This particularly space-saving arrangement is shown in FIG. 6. The transformer 6 is disposed inside an ignition unit 8', and comprises two coils, which are wound coaxially one over the other. The ignition unit 8' is supplied with a voltage via a plug 9, the voltage being supplied by an energy store or a generator, not shown. On the input side, the transformer 6 is connected to an integrated circuit 10, which can include the bridge circuit with switches, as well as the actuation electronics 5. On the output side, the transformer 6 supplies the electrodes 8.1 and 8.2 of the ignition unit 8'.

It is particularly advantageous that the arrangement can be minimized to the extent that it can be integrated into a cylinder head.

What is claimed is:

1. An integrated ignition unit for the ignition of an internal combustion engine, comprising:

a transformer having two coils forming a primary winding and a secondary winding;

a spark plug connected across the secondary winding of the transformer; and, an integrated circuit, including actuation electronics and circuit means having at least two switches, connected to the primary winding for supplying an AC voltage to the electrodes of the spark plug; and wherein the transformer and the integrated circuit form parts of a resonant transformation circuit for maintaining combustion across the electrodes, and the transformer is disposed within the ignition unit and consists of the two coils wound coaxially one over the other.

2. An integrated ignition unite according to claim 1, wherein the circuit means comprises a full-bridge circuit containing said two switches and two voltage sources in respectively different bridge arms.

3. An integrated ignition unit according to claim 1, wherein: the primary winding of the transformer is connected across a partial-bridge circuit comprising said two switches connected in respective bridge arms and the primary winding of the transformer is provided with a center tap that is connected to a voltage source.

4. An integrated ignition unit according to claim 1, further comprising an additional voltage source (UG) arranged in series with the secondary winding of the transformer.

5. An integrated ignition unit according to claim 1, wherein the circuit means comprises said at least two switches connected in a partial bridge circuit.

6. An integrated ignition unit according to claim 1, wherein the circuit means comprises said at least two switches connected in a push-pull circuit.

7. An integrated ignition unit according to claim 1, wherein the circuit means comprises four switches connected in a full-bridge circuit.

8. An integrated ignition unit according to claim 7, wherein the primary winding of the transformer is arranged in the bridge of the full-bridge circuit.

9. An integrated ignition unit according to claim 1, wherein the resonant circuit is resonant at the frequency of the AC voltage.

10. A method for operating an integrated ignition unit according to claim 1, comprising: generating the voltage arc-over of the spark plug through self-induction by reducing the current flux on the primary side of the transformer in jumps; and following the voltage arc-over, maintaining the combustion phase of the spark plug with a resonant voltage transformation.

11. A method according to claim 10, including using a single transformer for the self-induction and the resonant voltage transformation.

12. A method according to claim 10, wherein the resonant frequency is more than 100 kHz.

13. A method according to claim 10, wherein the resonant frequency is in the range of 1 MHz to several hundred MHz.

14. A method according to claim 10, wherein the step of maintaining includes providing the spark plug during the combustion phase with a high-frequency alternating voltage, on which is superimposed one of a direct voltage and a low-frequency alternating voltage with a frequency of at most 1/10 of the high-frequency alternating voltage.

* * * * *